US006192995B1

(12) United States Patent
Yamada

(10) Patent No.: US 6,192,995 B1
(45) Date of Patent: Feb. 27, 2001

(54) ROTARY IMPACTING APPARATUS

(75) Inventor: Sakuji Yamada, Kobe (JP)

(73) Assignee: Yamada Machinery Industrial Co., Ltd., Hyogo (JP)

( * ) Notice: Subject to any disclaimer, the term of this patent is extended or adjusted under 35 U.S.C. 154(b) by 0 days.

(21) Appl. No.: 09/313,655

(22) Filed: May 18, 1999

(30) Foreign Application Priority Data

Jul. 15, 1998 (JP) ..... 10-200673

(51) Int. Cl.[7] ..... B25D 15/02

(52) U.S. Cl. ..... 173/15; 173/122; 173/128; 173/205

(58) Field of Search ..... 173/205, 94, 128, 173/122, 109, 49, 124, 15

(56) References Cited

U.S. PATENT DOCUMENTS 3,108,644 * 10/1963 Gustafson ..... 173/122
3,642,077 * 2/1972 Bayard ..... 173/122
4,014,392 * 3/1977 Ross ..... 173/122
4,601,350 * 7/1986 Mikiya ..... 173/122
5,117,923 * 6/1992 Wuhrer ..... 173/109
5,488,997 2/1996 Yamada ..... 173/15

* cited by examiner

*Primary Examiner*—Scott A. Smith
(74) *Attorney, Agent, or Firm*—Michael D. Bednarek; Shaw Pittman

(57) ABSTRACT

A rotary impacting apparatus is provided that includes a housing, a rotor rotatable about an axis, a main reciprocative implement and an impact member. The impact member is arranged to exert an impacting force on the main reciprocative implement when the main receprocative implement is advanced relative to the axis. The rotor is supported by the housing via needle bearings.

10 Claims, 4 Drawing Sheets

ROTARY IMPACTING APPARATUS

BACKGROUND OF THE INVENTION

1. Field of the Invention

The present invention relates to a rotary impacting apparatus capable of providing high-frequency impacting force.

2. Description of the Related Art

Generally, an impacting apparatus such as a concrete breaker utilizes expansive force of compressed air or a combination of a motor and a crank mechanism for reciprocating an impacting piston in the main body. When reciprocated, the impacting piston repetitively hits a reciprocating implement supported at an end portion of the main body in an axial direction.

In the impacting apparatus of the above type, the impacting piston is forcibly reciprocated, so that the main body of the impacting apparatus will unfavorably be vibrated due to reaction from the impacting piston in motion. In addition, it is difficult to increase the frequency of reciprocation of the impacting piston due to the inertial mass of the impacting piston.

In order to overcome the above problems, the applicant of the present application proposed a rotary impacting apparatus as disclosed in U.S. Pat. No. 5,488,997. This rotary impacting apparatus includes a rotor which is rotatably supported by a housing, and a main reciprocative implement which is reciprocatively held by the housing. The rotor loosely retains an impact member. While the rotor is being rotated, the impact member repeatedly hits an impact receiving face of the main reciprocative implement, thereby causing the main reciprocative implement to reciprocate in a predetermined direction.

In the above rotary impacting apparatus, however, use is made of ball bearings for supporting the rotor within the housing. It has been found that the ball bearings, in repeated use, will often lose their initial function due to breakage of the ball retainers of the ball bearings for example. In such an unfavorable instance, the rotor may become unable to rotate smoothly or even unable to rotate at all.

SUMMARY OF THE INVENTION

It is, therefore, an object of the present invention is to provide a rotary impacting apparatus which overcomes the above-described problems.

According to the present invention, there is provided a rotary impacting apparatus comprising:

a housing;

a rotor rotatably accommodated in the housing;

a driving source for rotating the rotor about a rotation axis;

a main reciprocative implement reciprocatively held by the housing; and an impact member eccentrically held by the rotor, the impact member exerting an impacting force for pressing the main reciprocative implement when the main receprocative implement is advanced relative to the rotation axis;

characterised in that the rotor is supported by the housing via needle bearings.

With such an arrangement, the rotor is properly rotated since use is made of needle bearings for supporting the rotor instead of ball bearings.

According to a preferred embodiment, the main reciprocative implement is provided with an impact receiving face at which the impact member hits the main reciprocative implement, wherein the impact receiving face is arranged in parallel to the rotation axis.

The main reciprocative implement may comprise a shovel. Alternatively, the shovel may be replaced with a chisel.

Preferably, the impact member may have a columnar configuration.

The rotor may be formed with retaining holes for loosely retaining the impact member.

Preferably, a center of gravity of an assembly including the rotor and the impact member substantially coincides with the rotation axis when the rotor is rotating while the impact member is being held out of engagement with the main reciprocative implement.

When the main reciprocative implement comprises a shovel, it is preferable that the rotary impacting apparatus further comprises an auxiliary reciprocating member reciprocatively held by the housing for transmitting an impacting force from the impact member to the main reciprocative implement when the main reciprocative implement is advanced relative to the rotation axis by a predetermined distance.

The auxiliary reciprocating member may be rotatably held by the housing, whereas the main reciprocative implement may be nonrotatably held by the housing.

In the preferred embodiment, the rotor comprises a pair of flanges, a connector for connecting the flanges, and shafts projecting oppositely from the flanges, wherein the shafts are supported by the housing via the needle bearings.

Other objects, features and advantages of the present invention will become clearer from the detailed description of the preferred embodiment given below with reference to the accompanying drawings.

DETAILED DESCRIPTION OF THE PREFERRED EMBODIMENTS

The preferred embodiment of the present invention will be described below with reference to FIGS. 1–4 of the accompanying drawings.

Figure 1:
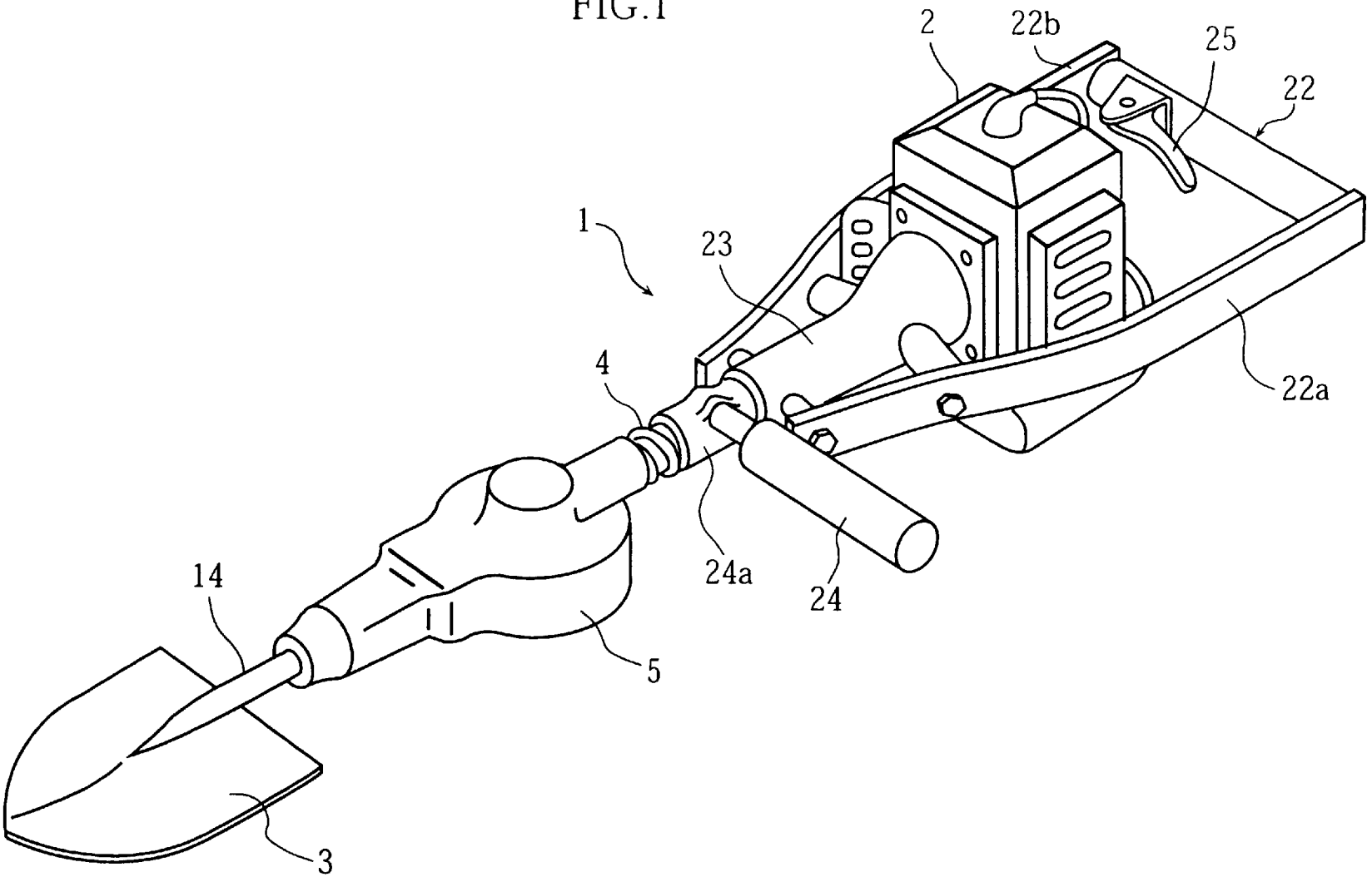
FIG. 1 is a perspective view showing a rotary impacting apparatus according to the present invention.

Reference is first made to FIG. 1 showing a rotary impacting apparatus 1 according to a preferred embodiment of the present invention. As is shown, the impacting apparatus 1 includes an engine 2 as a drive source and a shovel 3 (main reciprocative implement) suitable for digging or moving earth, stones and the like. The shovel 3 is provided with a shank 14 extending therefrom. The impacting apparatus 1 also includes a connection pipe 4 and a main housing 5. The main housing 5 may be made of aluminum and formed by die-casting for example.

Further, the impacting apparatus 1 is provided with a main handle 22 and an auxiliary handle 24. As shown in FIG. 1, the main handle 22 is supported by a pair of arm members 22*a*, 22*b* which are fixed to a clutch housing 23. The main handle 22 supports a throttle lever 25 provided for controlling the operation of the engine 2. The auxiliary handle 24 is attached to an outer pipe 24*a* into which the connection pipe 4 is inserted.

Figure 2:
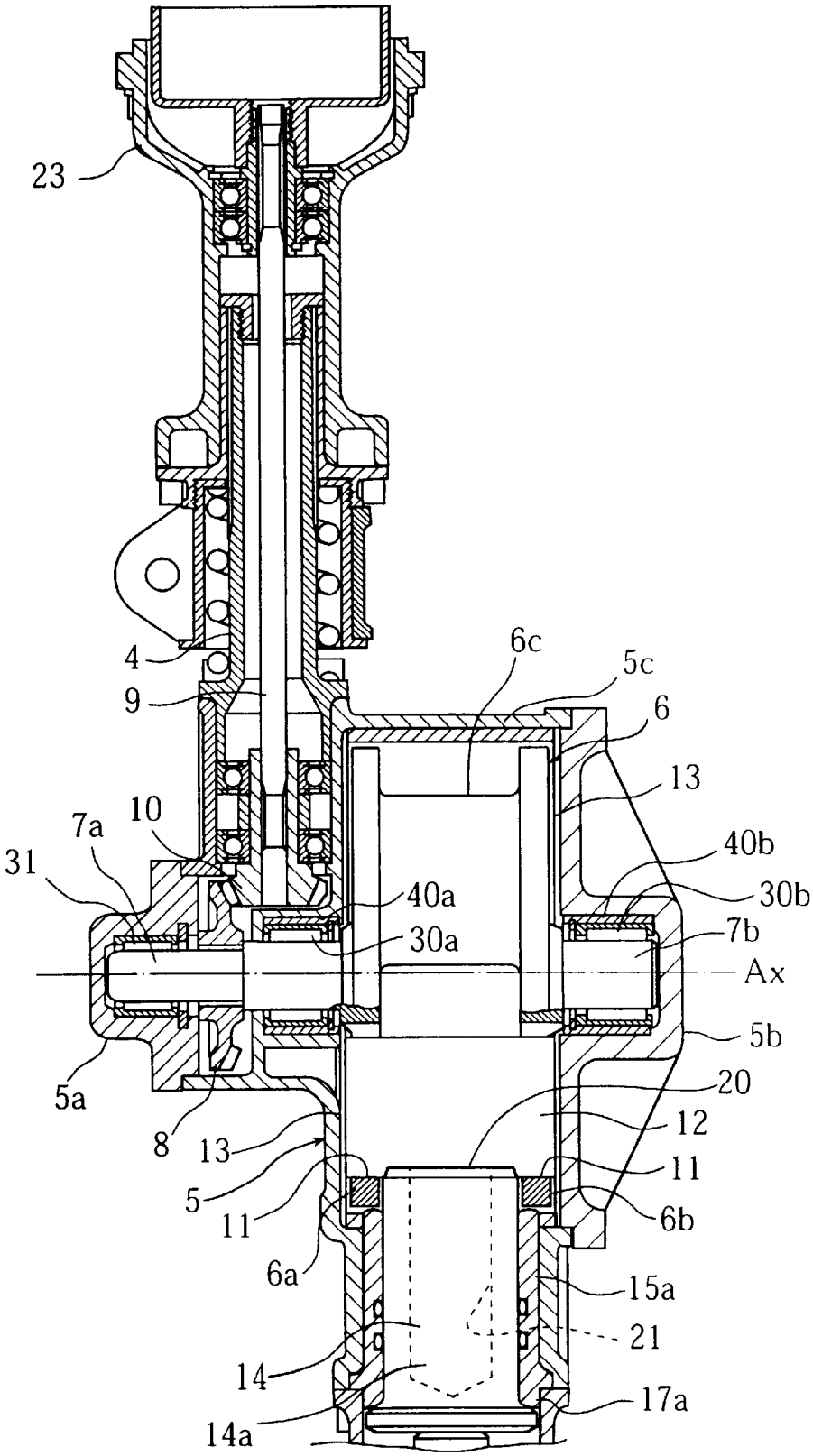
FIG. 2 is a sectional side view showing the impacting apparatus of FIG. 1.

As seen from FIG. 2, the main housing 5 is provided with a first and a second side walls 5*a*, 5*b* facing each other. Between these side walls, a space is provided for accommodating a rotary member 6. The rotary member 6 is formed with two shafts 7*a*, 7*b* projecting in the opposite directions. The respective shafts 7*a*, 7*b* have a common axis Ax about which the rotary member 6 is rotated. The shaft 7*a* is supported by the first side wall 5*a* via a needle bearing 30*a*, while the other shaft 7*b* is supported by the second side wall 5*b* via a needle bearing 30*b*.

In the illustrated embodiment, use is made of an additional needle bearing 31 for rotatably supporting the shaft 7*a* of the rotary member 6. The additional needle bearing 31 is directly supported by the housing 5, whereas the first two bearings 30*a*, 30*b* are supported by the housing 5 via metal collars 40*a*, 40*b*.

A bevel gear 8 is disposed between the needle bearings 30*a* and 31. The bevel gear 8 is fixed to the shaft 7*a* of the rotary member 6, so that when the bevel gear 8 is rotated, the shaft 7*a* (and consequently the rotary member 6) is simultaneously rotated. The bevel gear 8 is brought into engagement with another bevel gear 10 attached to an end of a transmission shaft 9. As shown in FIG. 2, the transmission shaft 9 extends through the connection pipe 4. The transmission shaft 9 is linked to the engine 2.

In the above arrangement, when the engine 2 is started to turn at a certain speed, a centrifugal clutch accommodated in the clutch housing 23 activates to transmit the rotational movement of the engine 4 to the transmission shaft 9. Then, upon rotation of the transmission shaft 9, the rotational movement is transmitted to the rotary member 6 via the bevel gears 8 and 10. As a result, the rotary member 6 begins to rotate about the axis Ax.

Figure 3:
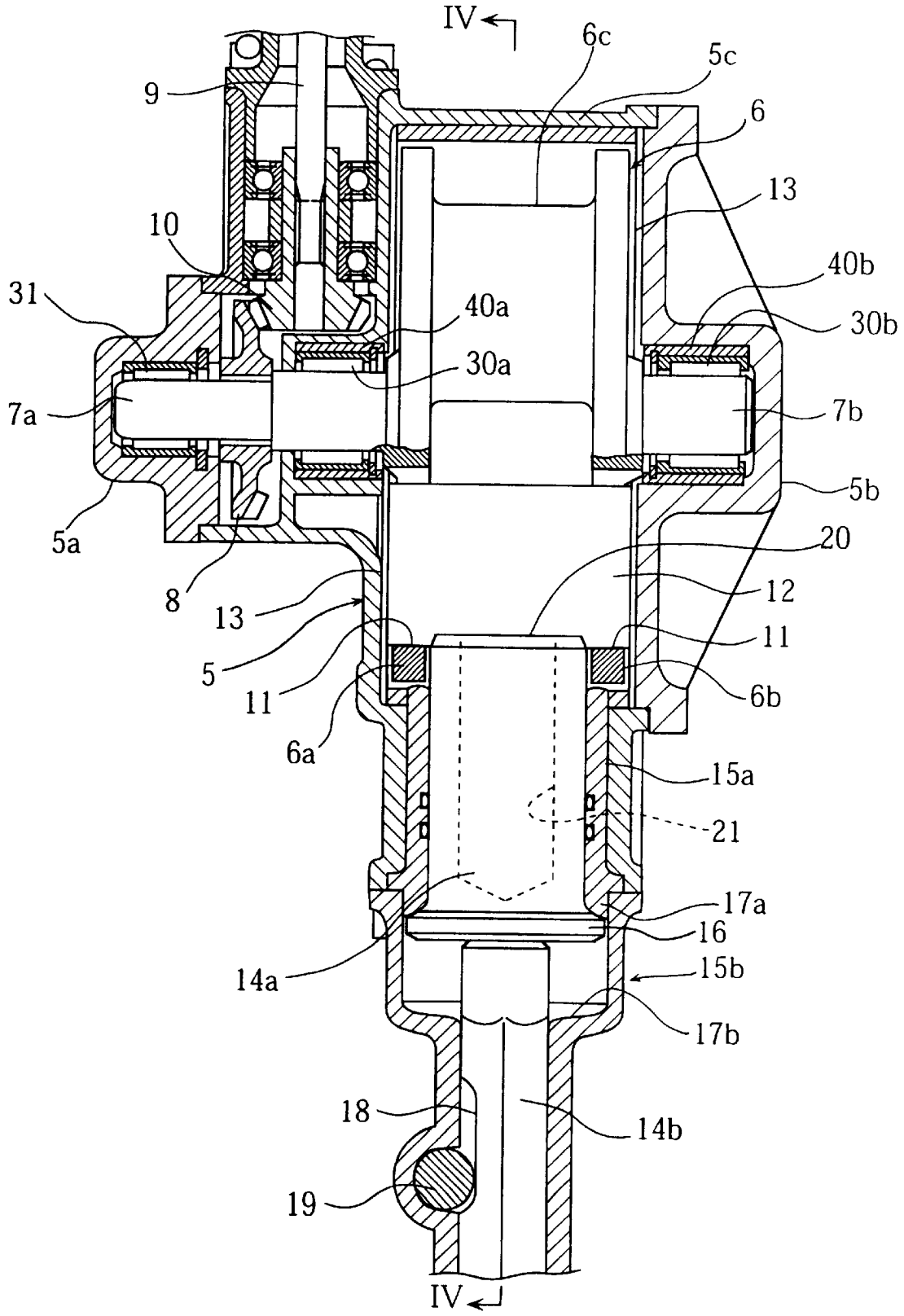
FIG. 3 is an enlarged sectional view showing principal components of the impacting apparatus of FIG. 1.

As shown in FIGS. 2 and 3, the rotary member 6 includes a first flange 6*a*, a second flange 6*b* and a connector 6*c*. The two flanges 6*a*, 6*b* are arranged in facing relation to each other. The connector 6*c* extends between the first and the second flanges 6*a*, 6*b*. In operation of the impacting apparatus 1, the connector 6*c* functions as a balance weight. The connector 6*c* is eccentrically held by the flanges 6*a*, 6*b* in a manner such that the axis of the connector 6*c* is offset from the rotation axis Ax (see FIG. 4).

Figure 4:
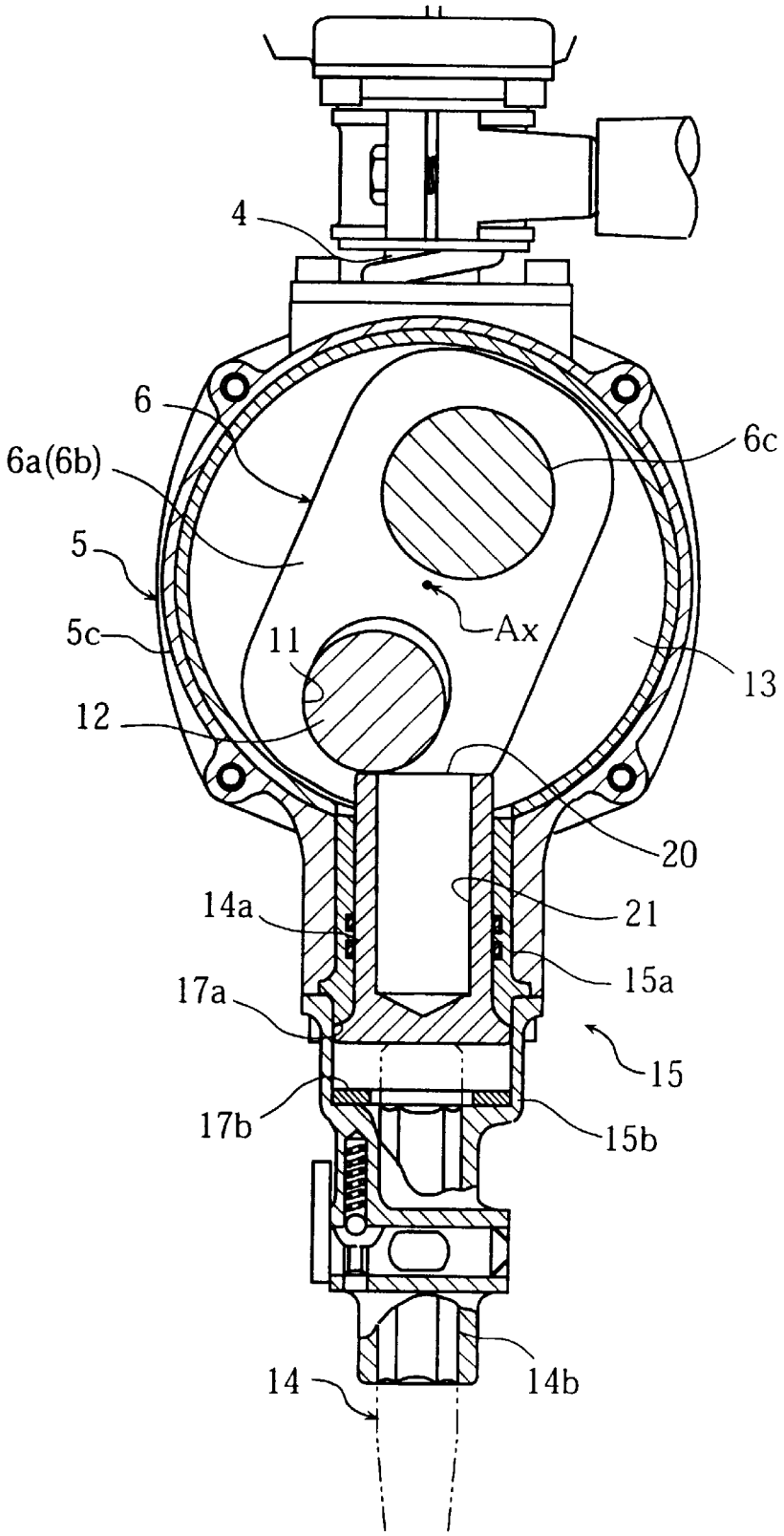
FIG. 4 is a sectional view taken along lines IV—IV in FIG. 3.

As shown in FIG. 4, each of the first and the second flanges 6*a*, 6*b* is formed with a retaining hole 11 located opposite to the connector 6*c* with respect to the axis Ax. The retaining hole 11 loosely retains each end of a columnar impact member 12. In this arrangement, the impact member 12 is eccentrically held by the rotary member 6 in a manner such that the axis of the impact member 12 is offset from the rotation axis Ax. The impact member 12 is rotatable in the retaining hole 11 and also movable radially within a limited range allowed by the retaining hole 11. For preventing the impact member 12 from moving in its axial direction, use is made of doughnut-shaped guide plates 13 flanking the rotary member 6 (see also FIGS. 2 and 3).

For enabling the rotary member 6 to rotate smoothly about the axis Ax, the rotary member 6 is arranged so that its center of gravity (as viewed in FIG. 4) will coincide with the axis Ax when the impact member 12 is moved farthest away from the axis Ax in the retaining hole 11.

As shown in FIG. 4, the main housing 5 is provided with a holder 15 for holding the shank 14 of the shovel 3. The shank 14 is slidably accommodated in the holder 15, thereby enabling the shovel 3 to reciprocate in the axial direction of the shank 14. As can be seen from FIG. 3, the central axis of the holder 15 extends through the center of of the rotary member 6. Thus, the axis of the holder 15 does not coincide with the axis of the connection pipe 4 (see also FIG. 2).

The holder 15 is divided into two parts, namely a first holding member 15*a* and a second holding member 15*b* connected to the first holding member 15*a*. Similarly, as shown in FIG. 3, the shank 14 is divided into a first shank portion 14*a* (auxiliary reciprocating member) and a second shank portion 14*b*. The first shank portion 14*a* is held in the first holding member 15*a*, while the second shank portion 14*b* is held in the second holding member 15*b*.

The first shank portion 14*a* is rotatable about its axis as well as movable in its axial direction relative to the first holding member 15*a*. The first shank portion 14*a* is provided, at a lower end, with a flange 16 which is diametrically greater than the main body of the first shank portion 14*a*. As shown in FIG. 3, the flange 16 can be moved in its axial direction between a lower edge 17*a* of the first holding member 15*a* and a stepped portion 17*b* of the second holding member 15*b*.

The second shank portion 14*b* is provided with a groove 18 extending in its axial direction. The groove 18 receives part of a stopper pin 19 which is held by the second holding member 15*b*. In this arrangement, the second shank portion 14*b* is movable through a predetermined distance in its axial direction, while being unable to rotate about its axis. As is easily understood, the combination of the groove 18 and the stopper pin 19 serves to prevent the second shank portion 14*b* from being pulled out from the second holding member 15*b*.

As shown in FIGS. 3 and 4, the first shank portion 14*a* has a flat, impact receiving face 20 which lies in a plane perpendicular the axis of the first shank portion 14*a*. The first shank portion 14*a* is formed with a shock absorbing bore 21 having a predetermined depth. In the illustrated embodiment, the shock absorbing bore 21 is upwardly open at the impact receiving face 20. Alternatively, the bore 21 may be entirely closed so that it is not exposed to the exterior.

As shown in FIG. 4, when the first shank portion 14*a* is lifted up to a maximum level in its stroke (this happens when the shovel 3 is pulled toward the rotation axis Ax), the impact receiving face 20 of the first shank portion comes into engagement with the impact member 12 which is spaced farthest from the axis Ax. Advantageously, the impact member 12 is arranged to hit the impact receiving face 20 at a particular portion thereof as shown in FIG. 4 (in the figure, that portion is the left extremity of the impact receiving face 20). If arrangements were made so that the impact member 12 hits the impact receiving face 20 at other positions thereof, the impact member 14 would fail to move the first shank portion 14*a* with a sufficiently great impacting force.

Though not illustrated, suitable lubricant-supplying means is provided in the main housing 5, so that lubricant is supplied to certain areas where a plurality of parts, components and the like are moved relative to each other (for instance, lubricant is supplied to the needle bearings 30*a*, 30*b*, 31 and the retaining holes 11).

The impacting apparatus 1 having the above arrangement operates in the following manner.

When the apparatus 1 is used for digging earth, the operator supports the apparatus 1 downwardly with his both hands. Specifically, the operator grips the main handle 22 with his right hand and the auxiliary handle 24 with his left hand. Then, the shovel 3 is held in pressing contact with the ground. At this stage, the first shank portion 14*a* (and the second shank portion 14*b* as well) is brought to the uppermost position of its stroke as shown in FIG. 4. In this state, when the throttle lever 25 (FIG. 1) is operated to allow the engine 4 to turn at a high speed, the centrifugal clutch held in the clutch housing 23 activates to transmit the rotational output of the engine 2 to the rotary member 6 via the transmission shaft 9.

As a result, the rotary member 6 hits the impact receiving face 20 of the first shank portion 14*a* upon each revolution of the motor 2, thereby driving the shovel 3 downward by an axial component of the impacting force from the impact member 12.

After the shovel 3 is driven into the earth to a desired extent, the operator releases the throttle lever 25 to stop the engine 2. Then, the ground is dug up by moving back and forth the main handle 22 of the impacting apparatus 1.

The impacting apparatus 1 described above has the following advantages.

First, owing to the shock absorbing bore 21, the first shank portion 14*a* is deflected when the impact member 12 hits the impact receiving face 20 of the first shank portion 14*a*. Thus, the first shank portion 14*a* and the impact member 12 will be held in pressing contact with each other (even for a short time) rather than instantly repelled from each other upon hitting. In this manner, the impact member 12 can reliably transmit an impacting force to the first shank portion 14*a*, and consequently to the shovel 3.

Second, according to the illustrated embodiment, lubricant is supplied to the retaining hole 11, thereby causing the impact member 12 to be moved smoothly within the retaining holes 11 (i.e., without generating much frictional heat). In addition, in presence of lubricant, it is possible to reduce the amount of frictional heat generated between the impact member 12 and the impact receiving face 20 when they are relatively moved in pressing contact with each other. As a result, unfavorable increase in temperature within the main housing 5 is advantageously prevented.

Third, in the impacting apparatus 1, three needle bearings 30*a*, 30*b*, 31 are used for supporting the rotary member 6. Since each of the needle bearings 30*a*, 30*b*, 31 supports the projecting shaft 7*a* or 7*b* of the rotary member 6 with an advantageously long contact area, the rotary member 6 is properly supported within the main housing 5. Thus, even when the rotary member 6 undergoes vibration or deflection (which may be caused when the gravitational center of the rotary member 6 is shifted from the rotation axis Ax), the rotary member 6 will be rotated smoothly. This advantage is enhanced by the metal collars 40*a*, 40*b* which are provided between the main housing 5 and the needle bearings 30*a*, 30*b*.

Fourth, when the operator supports the impacting apparatus 1 with shovel 3 held above the ground, the first and the shanks 14*a*, 14 are brought to the lowermost positions in their strokes. In this state, the first shank portion 14*a* is out of reach of the impact member 12 revolving around the axis Ax, thereby receiving no impacting force from the impact member 12.

It should be noted that when the impact member 12 is revolving around the axis Ax but does not hit the first shank portion 14*a*, the impact member 12 is spaced farthest from the axis Ax in the retaining hole 11 due to the centrifugal force. Under these circumstances, the gravitational center of the rotary member 6 put together with the impact member 12 coincides with the rotation axis Ax. Thus, the rotary member 6 will smoothly rotate about the axis Ax even at a high speed.

The present invention is not limited to the preferred embodiment described above. For instance, the rotary member 6 may be actuated by a different driving means other than the engine 2. Further, the shovel 3 may be replaced by a chisel suitable for breaking a concrete layer.

The impacting apparatus 1 may also be used for driving stakes into the ground. Further, when the shovel 3 is replaced with a flat scraper, the impacting apparatus 1 may be used for removing shellfish, mud or rust adhered to an outer wall of a ship.

Still further, the second shank portion 14*b* is rendered to be nonrotatable about its axis, so that a ground digging operation is easily performed with the shovel 3. However, when a chisel is used in place of the shovel 3, the second shank portion 14*b* may be rendered rotatable about its axis. In such an instance, the first and the second shank portions 14*a*, 14*b* may be integrally formed.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A rotary impacting apparatus comprising:

a housing:

needle bearings supported by the housing;

a rotor supported by the housing via the needle bearings for rotational movement about a rotation axis;

a driving source for rotating the rotor about the rotation axis;

a main reciprocative implement reciprocatively held by the housing; and an impact member eccentrically held by the rotor for exerting impacting force on the main reciprocative implement, the impact member being movable relative to the rotor between a first position and a second position, the first position being farther from the rotation axis than the second position is, wherein the impact member in the first position is disposed completely outward from the needle bearings in a radial direction of the needle bearings.

2. The rotary impacting apparatus according to claim 1, wherein the main reciprocative implement is provided with an impact receiving face at which the impact member hits the main reciprocative implement, the impact receiving face being arranged in parallel to the rotation axis.

3. The rotary impacting apparatus according to claim 1, wherein the main reciprocative implement comprises a shovel.

4. The rotary impacting apparatus according to claim 1, wherein the impact member has a columnar configuration.

5. The rotary impacting apparatus according to claim 1, wherein the rotor is formed with retaining holes for loosely retaining the impact member.

6. The rotary impacting apparatus according to claim 1, wherein a center of gravity of an assembly including the rotor and the impact member substantially coincides with the rotation axis when the rotor is rotating while the impact member is being held out of engagement with the main reciprocative implement.

7. The rotary impacting apparatus according to claim 1, further comprising an auxiliary reciprocating member reciprocatively held by the housing for transmitting an impacting force from the impact member to the main reciprocative implement when the main reciprocative implement is advanced relative to the rotation axis by a predetermined distance.

8. The rotary impacting apparatus according to claim 7, wherein the auxiliary reciprocating member is rotatably held by the housing, the main reciprocative implement being nonrotatably held by the housing.

9. The rotary impacting apparatus according to claim 10, wherein the rotor comprises a pair of flanges and a connector for connecting the flanges.

10. A rotary impacting apparatus comprising:

a housing;

needle bearings supported by the housing;

a rotor supported by the housing via the needle bearings for rotational movement about a rotation axis, the rotor being provided with a rotation shaft;

a driving source for rotating the rotor about the rotation axis;

a transmission shaft linked to the driving source and extending in a direction perpendicular to the rotation axis;

a bevel gear attached to an end of the transmission shaft and arranged close to the rotation shaft of the rotor;

a main reciprocative implement reciprocatively held by the housing; and an impact member eccentrically held by the rotor for exerting impacting force on the main reciprocative implement, wherein one of the needle bearings is inserted into a space between the bevel gear and the rotation shaft of the rotor.

* * * * *